US006088846A

United States Patent [19]

Baron

[11] Patent Number: 6,088,846

[45] Date of Patent: Jul. 18, 2000

[54] TOILET WATER REGULATOR

[76] Inventor: Marvin W. Baron, 10176 SW. 126 St., Miami, Fla. 33176

[21] Appl. No.: 09/443,892

[22] Filed: Nov. 19, 1999

[51] Int. Cl.[7] ..... E03D 1/36

[52] U.S. Cl. ..... 4/415; 4/366

[58] Field of Search ..... 4/366, 415

[56] References Cited

U.S. PATENT DOCUMENTS 5,125,120 6/1992 Baron ..... 4/415

*Primary Examiner*—Gerald A. Michalsky

*Attorney, Agent, or Firm*—Clarence L. Albritton

[57] ABSTRACT

A water regulation device for toilet flush system which can be mechanically inserted in a flush system to variably control by an adjustable valve member the amount of water that enters a flush operation, which operation is controlled by a cam member in operative mechanical communication with gearing and turbine member, the inlet water flow is initiated by a front arm setting of the cam to a high point to set an inlet valve to an open position to establish a water inlet regulation through turbine rotation and an adjustable valve in the outlet and simultaneously setting an outlet valve through the movement of a rear arm and both arms fall away thereby preventing the replenishment of water to a leaking tank and water for a flush-between-flush cycle.

20 Claims, 6 Drawing Sheets

TOILET WATER REGULATOR

FIELD OF THE INVENTION

The present invention relates to a device designed to save water in toilets and urinals that develop a leak.

BACKGROUND OF THE INVENTION

Conservation has become an issue of growing concern. As such, great efforts have been made to limit the waste of natural resources such as water. One area in which water waste has been scrutinized is in toilet use.

The focus of preventing water wasted in the use of toilets has until now been on the use of less water per flush. A float can be placed on the chain of a flapper valve and accordingly, the flapper will come down faster and allow less water to enter the tank and therefore less water is used per flush. Also, toilets are in use, generally on a commercial basis, based on a pressure system which have no tank but work with a pressure build-up to allow water flow when a handle is pulled. Additionally, new toilets have been developed which work with reduced amounts of water to complete the flushing action.

However, a leaking toilet will waste water at a rate dependent on the flow rate of the leak, regardless of how little water is used on a per flush basis. This is because toilets regulate the amount of water that exits the system and will allow water to flow through the system anytime the water valve exiting the system is open or leaks. This situation is complicated in tank toilet systems wherein the flapper valve in the water flow system is degraded by water, ultimately causing a leak.

It is estimated that leaking toilets are one of the larger sources of wasted water. This problem is especially significant in rental apartments, offices or warehouses where the occupant does not see the water bill and does not have an interest in fixing a leak quickly. Toilet Water Regulator U.S. Pat. No. 5,125,120, continuation-in-part of Ser. No. 569,568, filed Aug. 20, 1990, now abandoned, is a self-contained unit disposed in a tank and standing out of the water in the tank.

Moreover, U.S. Pat. Nos. 4,916,762 and 5,134,729 to Shaw show devices for metering the flow of water in a low silhouette tank whereby the device is disposed or submerged in the water of the tank and the operation and longevity of the device affected by the water in the tank.

Further, water metering systems that are submerged in water tend to have a shorter trouble-free operational span due to the deliquesce effect of chemicals in the water.

The present invention uses front and rear arms disposed on the shaft of a cam. The front arm is provided with a spring-biased, hinged locking mechanism for rotating the cam to set the cam to a high point and depress an associated inlet valve to begin a flush cycle and simultaneously actuate the rear arm and an associated flapper attached thereto to flush the tank. The front and rear arms are allowed to drop by sliding around the shaft on the cam A second flush is prevented until the turbine has taken the cam to its low point. Water is saved by preventing a flush between a flush cycle and by preventing water from coming into the tank when water is lost due to a cracked tank or leaky flapper valve.

SUMMARY OF THE INVENTION

Therefore, it is an object of the present invention to provide a toilet water regulation device that limits the amount of water that enters the system regardless of the water exiting the system during a flush cycle.

It is a further object of the invention to provide a regulation device that can be adjusted to predetermine the amount of water that will enter the system per flush.

It is another object to provide a regulation device which can be placed in a standard toilet tank or within standard pressure systems that is simple in its mechanism and has few working parts to limit the need for service or replacement. It is a further object of the invention to solve the double flush or flush-in-between flush by utilizing a rear arm in combination with a front arm whereby said front arm is utilized to activate a flush cycle and said rear arm is utilized to activate a water out-flow cycle wherein the distal end of the rear arm is attached to a flapper valve. The rear arm drops away after an initial flush the flapper floats down on its on and the arm can not be actuated between flushes. The "Toilet Water Regulator" above will operate properly with the second arm. Each arm is properly biased.

It is a further object of the invention to utilize the combination of a two-arm cam actuated valve, turbo system disposed to prevent an influx of fluid into a tank or water closet when fluid leaks from the tank or water closet.

BRIEF DESCRIPTION OF THE DRAWINGS

The following drawings, in which like reference characters represent like parts, are included to help understand the invention, and not to limit the invention, wherein.

DETAILED DESCRIPTION OF THE INVENTION

Figure 2:
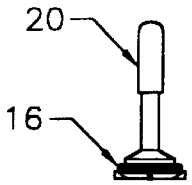
FIG. 2 is a side view of push pin 20 with o-ring 16.

These and other objects are achieved with a toilet water regulation device associated with the water inlet of a flush toilet system utilizing a tank comprising inlet valve means on the water inlet, said valve means having a water flow inlet, a water outlet divided into divergent outlets, turbine means placed in line with the water flow from one of said divergent outlets and the other of said divergent outlets directed to the tank, activation means which causes the inlet valve means to open and valve operation means cooperating with said turbine means to hold the inlet valve means open and close the inlet valve means after approximately a predetermined number of revolutions of the turbine means relating approximately to a predetermined amount of water passing over the turbine means, further comprising adjustable valve means cooperating with at least one of the divergent outlets to control water flow passing through the divergent outlet directed to the turbine means whereby the more water passing over the turbine means, the faster the turbine means will rotate and the less water will pass through the inlet valve means and into the tank before the inlet valve means closes.

The turbine means can be any type such as a propeller type paddle fan, ferris type, wind mill type or curved turbine. The turbine can be sealed and a housing is preferred to cover the turbine and limit water splashing from the turbine when water is directed to the turbine.

The inlet valve can be any type including hydraulic, water pipe, washer-free, diaphragm, carburetor type, arm type, gate, slide type, screw type, spring type, water pressure type, "V" type electric or air valve or limit switches used on worn gears or straight rods. However, the preferred valves are O-ring or ball valves having a water inlet, a push pin, an O-ring or ball which cooperates with said push pin and seats in an O-ring or ball seat due to water pressure from the inlet to prohibit water flow and a water outlet. The valve works so that when the pin is depressed, water flows through the valve and when the pin is extended, the O-ring or ball seats and water flow is prohibited.

The valve operation means preferably comprises a cam cooperating with said turbine means having a high portion, a low portion and a drop off point from said high portion to said low portion. The cam cooperates with the valve so that when the cam rotates across the drop off point the valve is changed from the open position to the closed position and water flow stops.

The cam is preferably associated with a round gear having teeth around the periphery thereof; the teeth of said round gear cooperates with a worm gear associated with the turbine. There are no missing teeth on the round gear. When the teeth of the round gear are engaged by the worm gear, and water turns the turbine, the turbine turns the worm gear and the worm gear turns the round gear. The turning round gear turns the cam about the high portion of the cam When the turbine turns a predetermined number of times, relating to a predetermined amount of water which passes over the turbine, the cam turns past the drop off point and the inlet valve shuts off.

A concentrically or non-concentrically mounted cam associated with a gear having teeth around the entire perimeter necessarily includes means to allow movement of the cam with out movement of the gear. Furthermore, straight gears can be used in the system, as can jack-type gears, or the cam can be unattached to the gears when utilizing a system such as that which is used in garage door openers. The gears can also be set-up similar to the timing gears of a pool or sprinkler shut-off pump.

Various sized gears can be used with the embodiments to vary the amount of water flowing over the turbine necessary to turn the cam past the drop off point. Also, additional gears can be placed between the turbine and the gear with which the cam is associated to vary the revolution of the turbine necessary to turn the cam past the drop off point. All such changes would be known to the skilled artisan in the gearing art.

The preferred method of regulating the amount of water needed to close the valve is found in the art of divergent water outlets from the inlet valve wherein one outlet directs water over the turbine and another goes directly to fill the system. One of the divergent outlets would have a separate adjustable valve, such as preferably a ball valve, or any of the types of inlet valves set forth above which can be set to a predetermined water flow, to directly or indirectly regulate water flow through the divergent outlet directed to the turbine. The more water that passes over the turbine, the faster the turbine turns and the faster the valve closes.

For example, since the water inlet into the system is constant, an adjustable valve reducing the flow to the divergent outlet not going to the turbine increases the flow over the turbine, speeding the time it takes to close the valve, so less water will enter the system before the valve closes. Similarly, increasing the water flow through an adjustable valve associated with the divergent outlet not going to the turbine causes less water to go over the turbine, taking longer for the valve to close and allowing more water into the system. The gears of the system, including the turbine, cam and intermediate gears used, are made of plastic, Nylon, Stainless Steel or Delrin. The pitch of the gears can be 32 pitch or 48 pitch; the 32 pitch is preferred. The O-ring is preferably made of a material that is resistant to chemicals and acid in water, namely, Silicone Rubber, Banner Rubber and Viton.

The activation means is preferably the same handle which is used to open the flapper valve in the bottom of the tank to release the water in the tank, or to activate the flush action in a pressure system with an extension which causes the cam to rotate to its high position, causing water flow. As such, the device can be installed in the tank of any Standard toilet utilizing a tank or in the standard pressure systems currently in use.

The device is preferably produced on a backing wall or plate and preferably includes a housing enclosing at least the turbine to limit water splashing from the turbine as water flows over it. The device can be placed directly on the inlet tube of the toilet tank on which the inlet float valve currently in use is mounted, for ease of installation.

DETAILED DESCRIPTION OF THE PREFERRED EMBODIMENT

Figure 4:
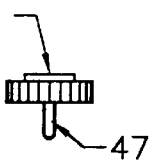
FIG. 4 is a side view of round gear 8 with projection 47.
Figure 6:
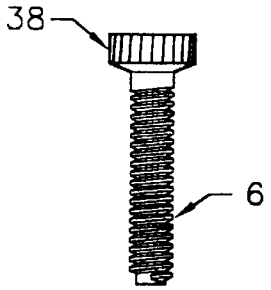
FIG. 6 is a side view of round gear 38 with worm gear 6.
Figure 3A:
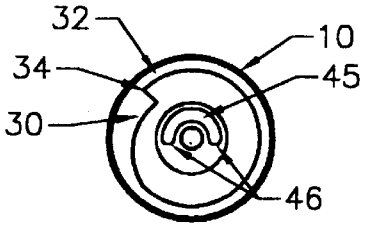
FIGS. 3*a* and 3*b* are top and side views of cam 10.
Figure 3B:
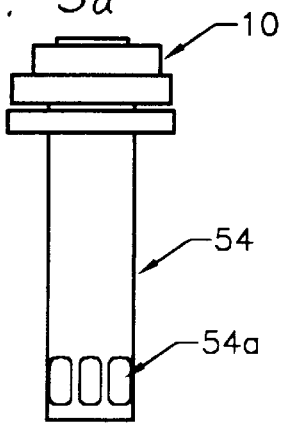
Figure 5A:
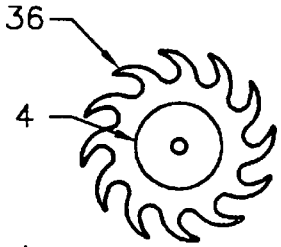
FIGS. 5*a* and 5*b* are top and side views of turbo 4 with worm gear 5.
Figure 5B:
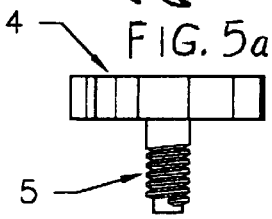
Figure 7:
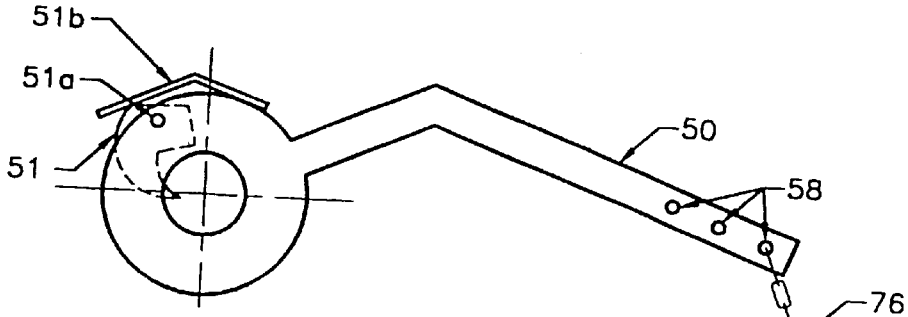
FIG. 7 is a front view of front arm 50.
Figure 8:
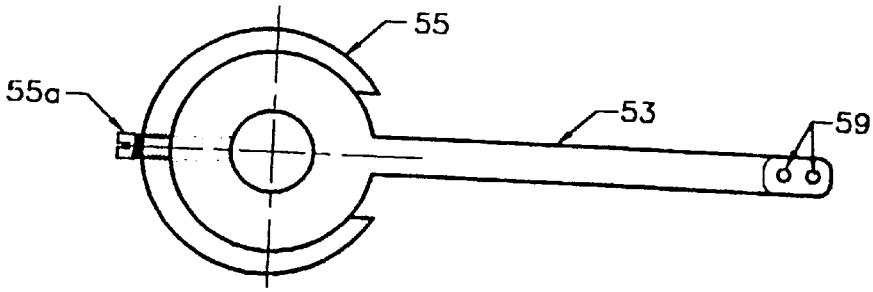
FIG. 8 is a front view of rear arm 53.
Figure 9:
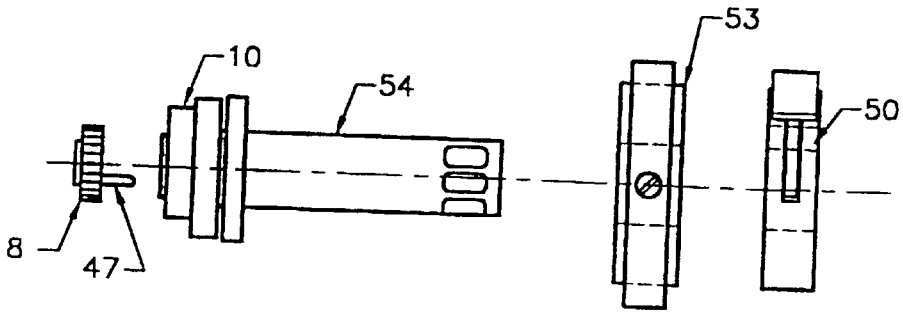
FIG. 9 is the configuration of the components on shaft 54 of the cam 10.
Figure 12:
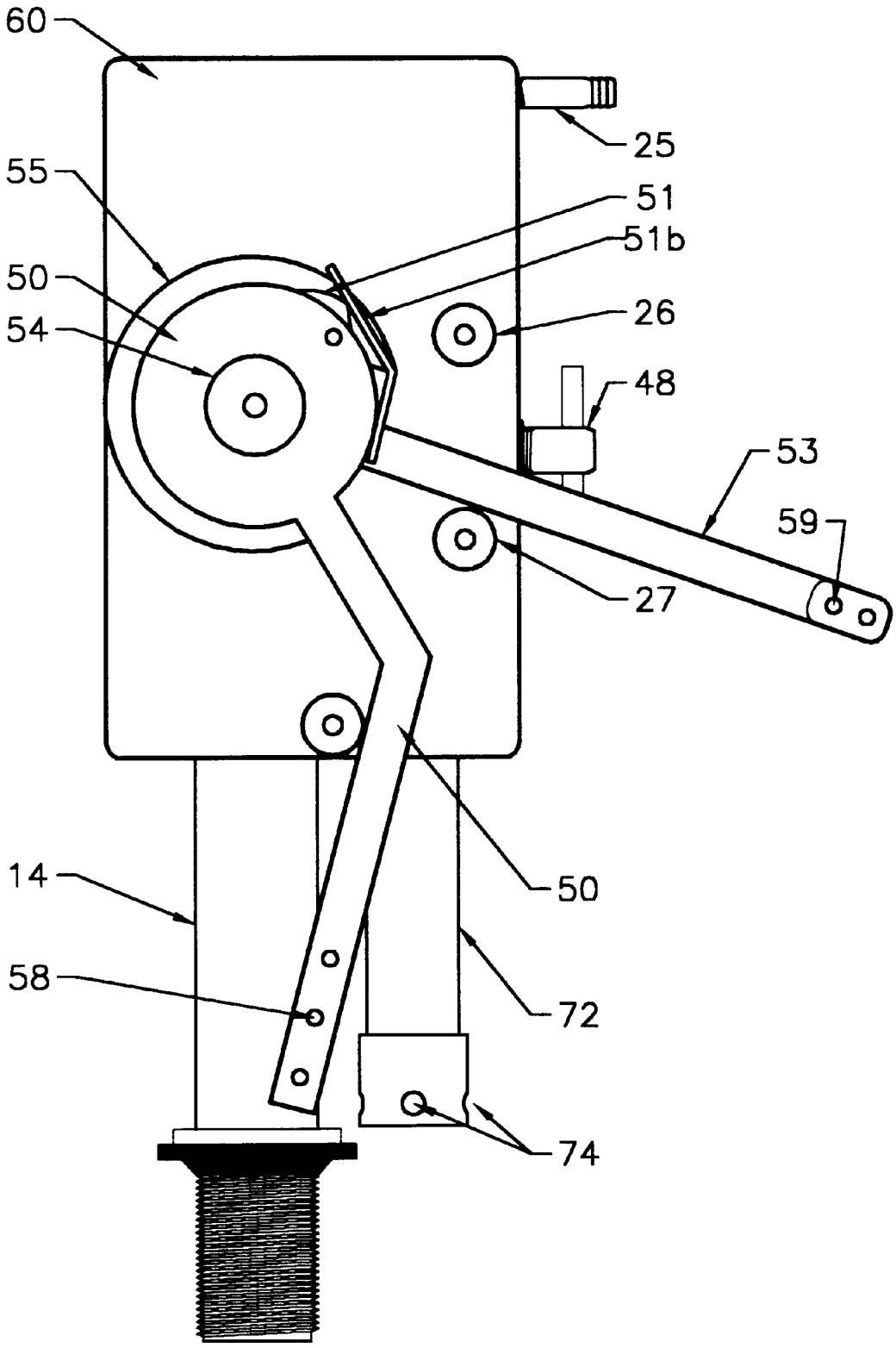
FIG. 12 is a front view of the Water Mizer mechanism.

With reference to the drawings, and specifically FIG. 12, the preferred embodiment of the water regulator device 2 of the present invention comprises a turbo 4 having a worm gear 5 attached (FIG. 5), a second worm gear 6 having a round gear 38 attached (FIG. 6), a round gear 8 having a projection 47 attached (FIG. 4), attached a cam 10 (FIG. 3) thereon with projection shaft 54 having a front arm 50 with hinged locking mechanism 51 (FIG. 7) and a rear arm 53 (FIG. 8) attached thereon (shown in FIG. 9). The cam 10 engages inlet valve which opens and closes in accordance with the position of the cam 10 in relation to the push pin 20. The inlet valve regulates water flow from a water inlet 14, such as a pipe or tube leading from a water supply to the inlet valve.

Figure 1A:
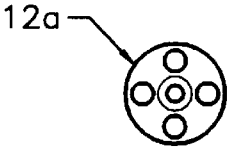
FIGS. 1*a* and 1*b* are top and side views of valve inlet block 12*a;*
Figure 1B:
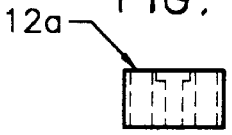

The inlet valve comprises a valve inlet block 12*a* (FIG. 1) mounted inside top of water inlet 14, a spring 12*b*, o-ring seat 18, a push pin 20 with an o-ring 16 (FIG. 2) and an inlet 22.

When the water supply is connected to the inlet valve, the pressure of the water and the pressure of the spring 12*b* force the o-ring 16 against the valve seat 18 and stop water flow.

The cam 10 works in cooperation with the push pin 20 of the inlet valve. The pin 20 is in proximity with the cam 10 so that the pin 20 is depressed and extended by the high and low points of the cam 10 respectively. When the cam 10 is in its low position 30 with relation to the pin 20, the device is in its ready position fully extended, whereby the o-ring 16 seats against valve seat 18 and will not allow water to pass through the inlet valve regardless of the water level in the tank. However, when the pin 20 is engaged by the high phase of the cam 10, from the beginning of the high portion 32 to the drop off point 34, the cam 10 depresses the pin 20 to the point where the o-ring 16 moves away from the o-ring seat 18 and allows water to flow through the inlet 22.

Figure 13:
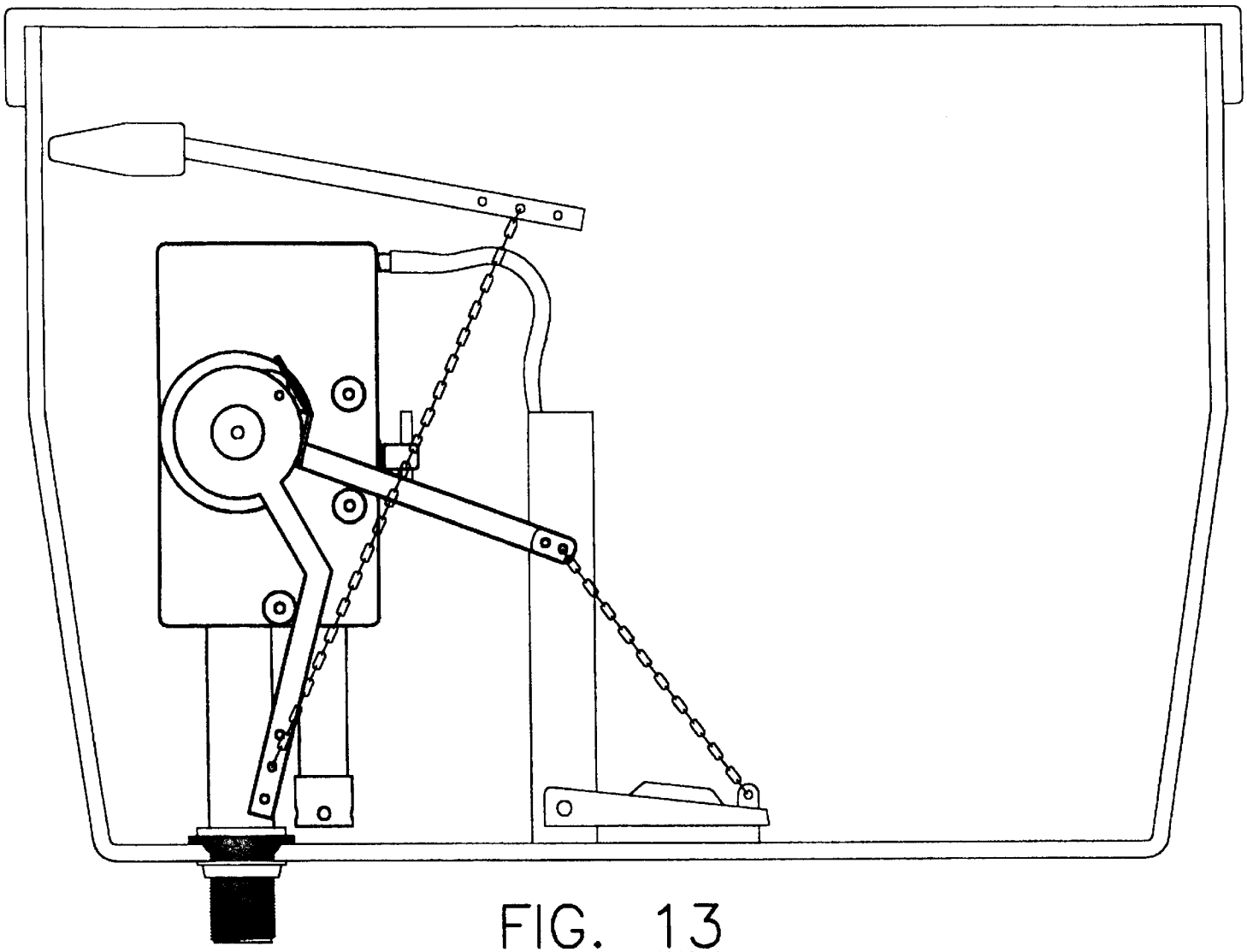
FIG. 13 is a front view of the Water Mizer installed in a typical toilet tank.

The front arm 50 having a hinged locking mechanism comprising swiveling claw 51 rotating about pin 51*a* and forced inward by a flat spring 51b attached to arm 50, and the rear arm 53 having a spring 55 being tensioned with screw 55*a* engage projection 54 of cam 10. The front arm 50 having one end of chain 76 attached at holes 58 of arm 50 and the other end fastened to hole in standard toilet handle means. The tip of claw 51 seats in slots in shaft 54 of cam 10 when front arm 50 is activated thereby rotating cam 10 to the high portion 32 depressing pin 20 allowing water to flow through the inlet 22 before dropping off independent of rotating cam when toilet handle means falls back to its starting position, likewise thereby rotating rear arm 53 having end of flapper valve chain attached at holes 59 of arm 53 (shown in FIG. 13) thereby lifting flapper valve at the bottom of tank to let water flow out of the tank.

The rear arm 53 is necessary to the device in that the rear arm 53 lifts the flapper valve. The flapper drops off when the rear arm 53 contacts arm stop 26 the rear arm 53 falling back to its starting position on arm rest 27. This invention will not work without rear arm 53.

Figure 10:
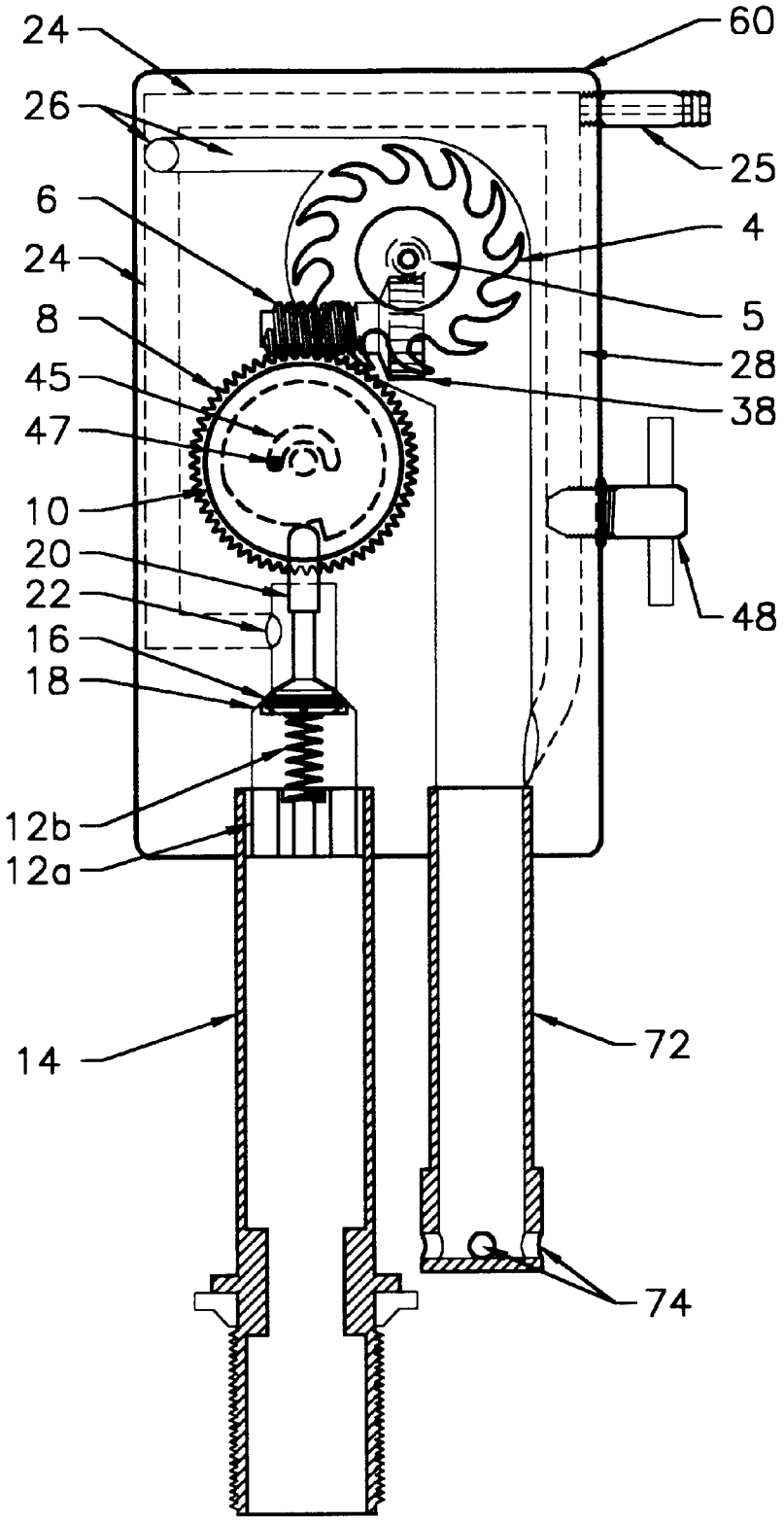
FIG. 10 is a sectional view showing the configuration of the components in block 60.
Figure 11:
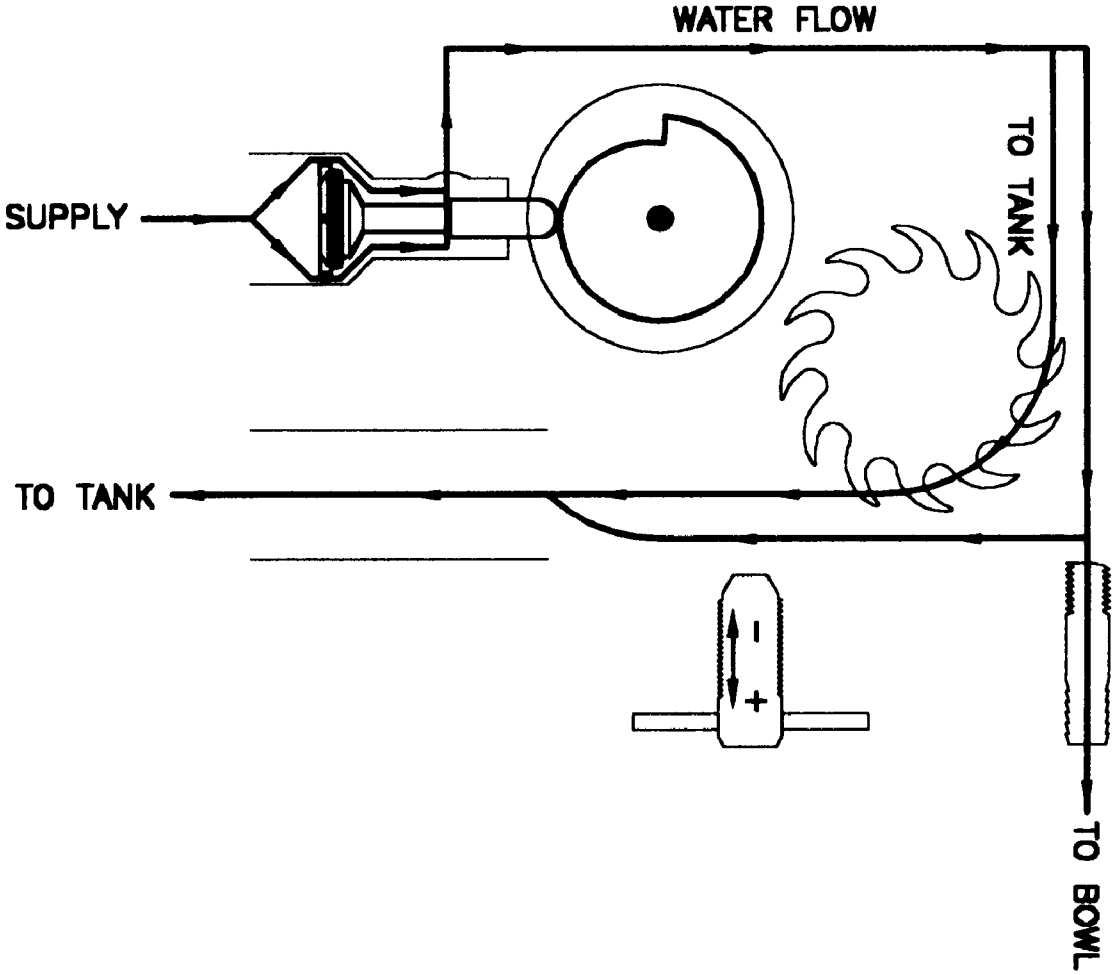
FIG. 11 is a schematic view of fluid flowing through the device.

The inlet The inlet valve preferably supplies three divergent outlet lines 24, 26, and 28 (FIG. 10). Line 24 feeds the overflow in a standard tank through a barbed nipple 25 which cooperates with a standard hose and clip. Line 26 ends adjacent to the turbo 4. Line 28, its flow being regulated by an adjustable valve 48, converges with water from line 26 and goes to the bottom of the tank through holes 74 of down-flow tube 72 to help fill the tank more quietly.

At this point, the water begins to flow through the valve 12 to lines 24, 26, and 28. The flow from the line 26 which passes over the blades 36 of the turbo 4 causes the turbo 4 to revolve at a rate proportional to the amount of water passing over it.

As the turbo 4 turns with water passing over it, it turns the worm gear 5 attached concentrically about the axis of the turbo 4. The teeth of the worm gear 5 are in constant engagement with the teeth of an end gear 38 attached concentrically about the axis of the second worm gear 6. Rotation of the turbo 4 therefore causes rotation of the second worm gear 6.

The teeth of the worm portion of the second worm gear 6 engage the teeth of the round gear 8 to rotate the round gear 8 and projection 47 in slot 45 of cam 10 to stop 46 thereby rotating cam 10 on its projection or attachment axis 44 across the high portion of the cam 10 (i.e. from the beginning of the high portion 32 to the drop off 34). At the drop off point 34 the pin 20 is extended, the o-ring 16 seats, water stops flowing and the turbo 4 stops spinning.

It is understood that the projection 47 can be attached to cam 10 and round gear 8 would then have slot 45 with stops 46. Cam 10 turns as indicated above.

The use of an intermediate worm gear 6 is not essential to the invention, wherein the worm gear 5 attached concentrically to the turbo 4 can directly engage the teeth of the round gear 8. However, the use of the second worm gear 6 is preferred for regulating the timing relating to the number of rotations of the turbo 4 necessary for a full rotation of the cam 10.

Alternatively, elimination of the intermediate worm gear 6 may require a larger round gear 8 to provide proper timing when used in standard tank system.

The turbo 4, worm gear 5, end gear 38, second worm gear 6, round gear 8, cam 10, front arm 50 and rear arm 53 can be made of any suitable material including plastics, nylon, stainless steel, polyesters, etc., with plastic or nylon being preferred. Suitable for this use is Derlin plastic. The preferred gears are 32 pitch.

The o-ring 16 can be made of rubber or other suitable material and is preferably made of Silicone or Viton to ensure long life.

The housing 60 is preferably made of plastic, Plexiglass, or a like material generally shaped to conform to its components.

A preferred configuration of the present invention is shown in FIG. 10 mounted in block 60.

The device is activated by the flush activation means of the toilet in cooperation by chain 76 with the front arm 50 and having a hinged locking mechanism which rotates the cam 10. The high point 32 of the cam 10 depresses the pin 20 allowing water to flow through the inlet valve.

The water flows through the inlet 22 and through divergent outlet lines 24, 26 and 28. The water flowing through the first line 24 goes to the overflow, as is standard in most toilets, the second line 26 is directed to just above the blades 36 of the turbo 4 to turn the turbo 4 goes to the bottom of the tank to quietly fill the tank, and the third line 28. The water flow from the turbo 4 converges with the second line 26 then goes through outlet 72 and finally through holes 74 to the bottom of the tank to quietly fill the tank.

When the gears rotate to the point that the pin 20 passes the drop off point 34 and is allowed to extend, the pressure from the water and the spring 12*b* at the water inlet 14 closes the inlet valve 12 by seating the o-ring 16 in the o-ring seat 18 and the water flow stops. The absence of water flow also stops the turbo 4 and all subsequent gears from rotating.

Since the gearing of the device 2 works with the volume of water passing over the turbo 4 on a timing theory, the amount of water to pass through the valve on a per flush basis can be regulated in a number of ways. This is important where use of the device would eliminate the need for a float valve in a standard toilet tank.

One way to regulate the volume of water going through the inlet valve is to change the size or number of the gears between the turbo 4 and the cam 10. For example, the larger the round gear 8, the longer it will take for the cam 10 to make a full rotation and the longer the pin 20 will be depressed, allowing more water to flow. Similarly, a smaller round gear 8 will allow less water to flow.

The preferred method of regulating the volume of water, however, is to put a regulating device, i.e. an adjustable valve 48, on one or both of the lines 24 and 28 or on line 26 to regulate the flow of water over the turbo 4. For example, the less water that flows through lines 24 and/or 28, the more water will flow through line 26 and the faster the turbo 4 will spin. Likewise, when more water is allowed to flow through line 26 the faster the turbo 4 will spin. The faster the turbo 4 spins, the less time it will take for a fill rotation of the cam 10, the less water will pass through the valve.

Similarly, the more water that passes through lines 24 and 28, through closing or reducing water flow through a valve (not shown) on line 28 or opening or increasing water flow through a valve 48 on line 26 and/or a valve (not shown) on line 24 the less water passes over the turbo 4. The less water over the turbo 4 the slower the rotation of the gears and the more water will pass into the tank through the combined flow through lines 26 and 28 before the cam 10 allows the pin 20 to extend and flow through the inlet valve to stop.

Of course, when the device is installed in a tank system (FIG. 13) and there is a leak in the flapper valve, the tank will empty but water will not flow into the tank due to the device. Therefore when flushing the toilet, the handle will have to be activated twice, once to fill the tank with water and another time to flush.

While the invention has been described in detail and with reference to several specific embodiments thereof, it will be apparent to one skilled in the art that various changes and modifications can be made therein without departing from the spirit and scope thereof. For example, a straight gear may be used between the turbo 4 and the cam 10, or gear means without teeth, causing rotation by contact or belts. Such obvious variations, however, are covered by the invention, limited only by the appended claims.

I claim:

1. A toilet water regulation device comprising a housing, said regulation device including an inlet valve and divergent outlets, operative turbine means in line with water flow from one of said divergent outlets, activation means operative to set the inlet valve to an open position, adjustable valve means in cooperation with at least one of said outlets to control the amount of water entering the housing, a cam with shaft means in operative communication with said turbine and gear means for controlling inlet water flow action in response to said turbine rotational operation, said activation means comprising front and rear arms coupled to said shaft and pivoted on said shaft, said front arm operative to set the cam to a high position and said inlet valve open for inlet water flow to the housing while the rear arm is operative to open a flapper valve.

2. The device of claim 1 wherein said housing is mounted in a flush system.

3. The device of claim 1 wherein the inlet valve means comprises an o-ring valve, having a water flow inlet, a push pin, an o-ring which cooperates with said push pin and seats in an o-ring seat due to water pressure from the water flow inlet to prohibit water flow through the water outlet wherein when the push pin is depressed water flows through the outlet and when the pin is extended the o-ring seats and water flow stops.

4. The device of claim 3 wherein the valve operation means comprises said cam in communication with said turbine means, said cam having a high portion, a low portion, and a drop off point from said high portion to said low portion, wherein the cam is operative to actuate the pin of the inlet valve so that when said cam is in its low position the pin is extended, when the cam is in its high position the pin is depressed and when the pin goes past the drop off point the pin goes from a depressed to an extended position.

5. The device of claim 4 further comprising a first round gear with a projection which cooperates with a slot in the cam, said first round gear cooperates with a first worm gear associated with a second round gear which cooperates with a second worm gear associated with the turbine means wherein each said worm gear is rotated upon rotation of the turbine means thereby rotating the cam.

6. The device of claim 5 wherein the cam is concentrically, pivotally attached to the first round gear, the first round gear having teeth about the entire perimeter thereof, wherein the round gear further comprises a shaft non-concentrically, mounted thereon extending into and engaging a semi-circular slot in the cam to allow rotation of the cam from its low position to its high position, causing water to flow, without rotation of the round gear.

7. The device of claim 5 wherein the cam is concentrically, fixedly attached to the first round gear and the round gear has teeth missing from a strategic location about a portion thereof to allow the activation means to rotate the cam from its low position to its high position, to begin the water flow over the turbine means, by allowing the round gear to rotate across the worm gear without interference from engagement of the teeth thereof.

8. The device of claim 5 wherein the cam is non-concentrically, pivotally attached to the round gear to allow the cam to be moved from its low position to its high position, to begin the water flow over the turbine means, without rotation of the round gear wherein said round gear has teeth about its entire perimeter which are in constant engagement with the worm gear.

9. The device of claim 8 wherein the pivotal end of the front arm member further comprises a counterclockwise locking means that acts on a slot in said projection member, so that when the arm member is rotated, the cam through contact with the stop of the slot in the projection member rotates, and the arm member pivots clockwise without further affecting rotation of the cam.

10. The device of claim 5 wherein the cam is concentrically, pivotally attached to the round gear, the round gear having teeth about the entire perimeter thereof, wherein the cam further comprises a shaft non-concentrically, fixedly mounted thereon extending into and engaging a semi-circular slot in the round gear to allow rotation of the cam from its low position to its high position, causing water to flow, without rotation of the round gear.

11. The device of claim 5 wherein the turbo, the round gears, the cam, and the worm gears are made from materials taken from the group consisting of plastic, Nylon, Stainless Steel and Delrin.

12. The device of claim 1 wherein the housing outlet further comprises a down-flow tube to the lower portion of the tank to quietly fill the tank with water directed over the turbine means.

13. The device of claim 12 wherein the housing outlet further comprises vent openings to enhance water flow through the housing outlet to the tank.

14. The device of claim 1 wherein the adjustable valve means cooperates with the divergent outlet directed to the turbine means, to variably adjust the flow of water over the turbine means and therefore the speed of rotation of the turbine means and the total water flow through the device before the inlet valve closes.

15. The device of claim 1 wherein the adjustable valve means cooperates with the divergent outlet directed to the tank to variably adjust the flow of water and inversely adjust the flow of water through the divergent outlet directed to the turbine means, and therefore the speed of rotation of the turbine means and the total water flow through the device before the inlet valve closes.

16. The device of claim 1 wherein the adjustable valve means is taken from the group consisting of a ball valve, a screw-type valve, a diaphragm valve, a carburetor-type valve, an arm-type valve, a gate-type valve, and a slide-type valve.

17. The device of claim 1 wherein the activation means further comprises a projection member on the cam to which the pivot end of said front arm member is pivotally mounted at one end which cooperates with said projection member and a second end which cooperates with the toilet flush action activation means, wherein the toilet flush action activation means is activated, said means to move said arm member which in turn rotates the cam through cooperation with said projection member, the throw of the front arm member upon pivoting being about equivalent to rotation of the cam from its low position to its high position.

18. A toilet water regulation device associated with the water inlet of a flush toilet system utilizing a tank and bowl comprising a housing, inlet valve means in said housing adapted to communicate with the water inlet, said inlet valve means having a water inlet divided into divergent outlets, turbine means placed in line with the water flow from one of said divergent outlets and another of said divergent outlets directed to the tank, activation means which causes the inlet valve means to open and valve operation means cooperating with said turbine means to hold the inlet valve means open and close the inlet valve means when the turbine means has turned approximately a predetermined number of revolutions of the turbine means relating approximately to a predetermined amount of water passing over the turbine means, adjustable valve means cooperating with at least one of the divergent outlets to control water flow passing through the divergent outlet directed to the turbine means whereby the more water passing over the turbine means the faster the turbine means will rotate and the less water will pass through the inlet valve means before the inlet valve means closes, said activation means further comprising cam means with a projection shaft, front arm means and rear arm means, said front arm means having a spring-biased, hingely-supported locking means and said rear arm means is spring-biased with spring tension adjustment means, said front and rear arm means engaging the shaft projection of said cam, said front and rear arms operative to produce a toilet flush action whereby the front arm sets the cam to a high point and the rear arm raises a flapper valve allowing water in the tank to flow to the bowl.

19. The device of claim 18 wherein the o-ring is made of Silicone.

20. A toilet water regulation device associated with the water inlet of a flush toilet system utilizing a tank comprising a housing, inlet valve means in said housing and adapted to communicate with the water inlet, said inlet valve means having a water inlet divided into divergent outlets, turbine means placed in line with the water flow from one of said divergent outlets and another of said divergent outlets directed to the tank, activation means which causes the inlet valve means to open and valve operation means cooperating with said turbine means to hold the inlet valve means open and close the inlet valve means when the turbine means has turned approximately a predetermined number of revolutions of the turbine means relating approximately to a predetermined amount of water passing over the turbine means, adjustable valve means cooperating with at least one of the divergent outlets to control water flow passing through the divergent outlet directed to the turbine means whereby the water passing over the turbine means the faster the turbine means will rotate and the less water will pass through the inlet valve means before the inlet valve means closes, said valve operation means including cam means with a projection shaft, said activation means including front arm means and a cooperative rear arm means located on said shaft for flushing whereby the proximal end of the first arm is coupled to the projection shaft and the proximal end of the second arm is coupled to said shaft while the distal end of the first arm is in communication with a flush member and the distal end of the rear arm is in communication with a flapper valve.

* * * * *